United States Patent [19]

Hill

[11] Patent Number: 4,658,619

[45] Date of Patent: Apr. 21, 1987

[54] MACHINE FOR SPLINING CLUTCH HUBS

[75] Inventor: Gary R. Hill, Holland, Mich.

[73] Assignee: Ex-Cell-O Corporation, Troy, Mich.

[21] Appl. No.: 842,094

[22] Filed: Mar. 20, 1986

Related U.S. Application Data

[63] Continuation of Ser. No. 531,092, Sep. 12, 1983, Pat. No. 4,596,127.

[51] Int. Cl.[4] ..... B21D 17/04; B21H 5/00

[52] U.S. Cl. ..... 72/88; 72/469

[58] Field of Search ..... 72/88, 90, 469, 108, 72/106, 105; 29/159.2

[56] References Cited

U.S. PATENT DOCUMENTS

| | | | |
|---|---|---|---|
| Re. 31,116 | 1/1983 | Anderson | 72/108 |
| 76,220 | 3/1868 | Mason . | |
| 384,091 | 6/1888 | Simonds | 72/469 |
| 440,763 | 11/1890 | Simonds | 72/88 |
| 1,510,889 | 10/1924 | Hooker . | |
| 1,972,225 | 9/1934 | Hogue | 72/90 |
| 3,062,077 | 11/1962 | McCardell . | |
| 3,214,951 | 11/1965 | McCardell . | |
| 3,407,638 | 10/1968 | Greis et al. . | |
| 3,473,211 | 10/1969 | Lindell . | |
| 3,630,058 | 12/1971 | Kiplinger et al. | 72/96 |
| 3,982,415 | 9/1976 | Killop | 72/469 |
| 4,028,922 | 6/1977 | Killop | 72/88 |
| 4,045,988 | 9/1977 | Anderson | 72/108 |
| 4,155,237 | 5/1979 | Jungesjo | 72/88 |
| 4,383,428 | 5/1983 | Jungesjo | 72/88 |
| 4,485,657 | 12/1984 | Ridley | 72/88 |

FOREIGN PATENT DOCUMENTS

| | | | |
|---|---|---|---|
| 869924 | 10/1981 | U.S.S.R. | 72/88 |

*Primary Examiner*—Daniel C. Crane

*Attorney, Agent, or Firm*—Edward J. Timmer

[57] ABSTRACT

In pressure forming splines or teeth in the axially-extending sleeve of a clutch hub having a cylindrical oil seal surface adjacent the sleeve, a pair of special tooth-forming racks adapted to intermesh with a toothed mandrel with the sleeve therebetween and a pair of special support racks adapted to contact the oil seal surface are used. Each tooth-forming rack includes a first working surface with a plurality of toothed sections interrupted and spaced apart by toothless sections in an alternating sequence and each further includes a second working surface with uninterrupted toothed sections. Each support rack includes a first working surface with raised support sections interrupted and spaced apart by lower non-supporting sections in a proper alternating sequence and configuration to insure that the raised sections support the oil seal surface when the interrupted toothed rack sections of the tooth-forming racks deform the sleeve. A second working surface of the support racks includes a raised support section similarly adapted to support the oil seal surface during initial contact of the uninterrupted rack teeth of the tooth-forming racks with the sleeve. A clutch hub is thereby manufactured having a splined sleeve roundness within 0.025 inch and oil seal surface roundness within 0.006 inch.

3 Claims, 12 Drawing Figures

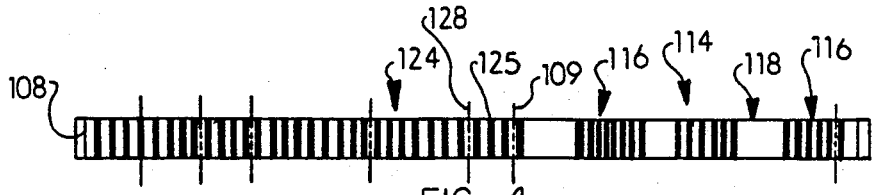
FIG. 4
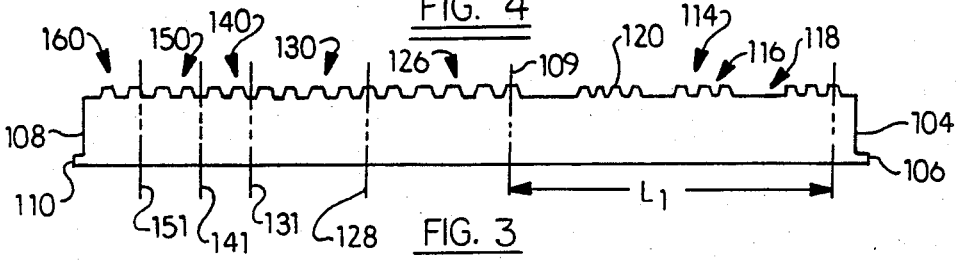
FIG. 3
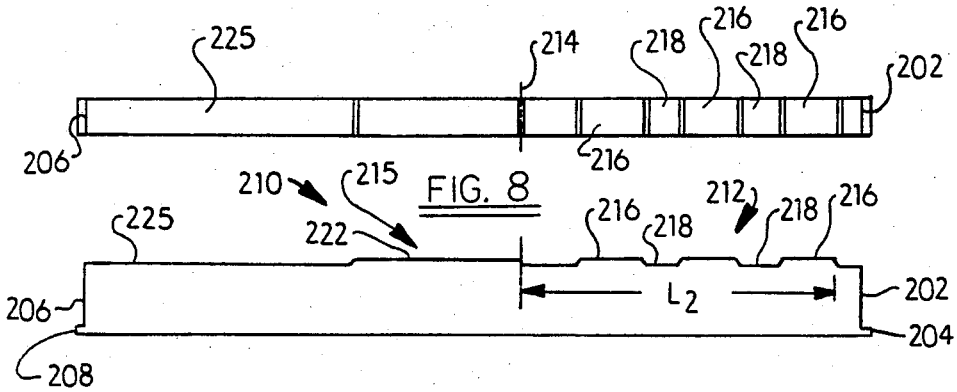
FIG. 8
FIG. 7

MACHINE FOR SPLINING CLUTCH HUBS

This application is a continuation of application Ser. No. 531,092, filed 9/12/83, now U.S. Pat. No. 4,596,127, issued 6/24/86.

FIELD OF THE INVENTION

The present invention relates to machines and methods for pressure forming splines or teeth on a cup-shaped power transmission member by intermeshing mandrel teeth and rack teeth.

BACKGROUND OF THE INVENTION

The manufacture of power transmission members, to which this invention relates, has utilized a pair of slidable toothed racks and a rotatable toothed mandrel to develop the tooth form in the periphery of an annular or tubular workpiece. A machine has been provided for rotatably supporting the mandrel between the pair of toothed racks which are mounted for sliding motion past opposite sides of the mandrel on slide members.

The McCardell U.S. Pat. No. 3,214,751 issued Nov. 2, 1965 of common assignee herewith discloses a machine of this type having a rotatable cylindrical mandrel and a pair of tooth forming racks disposed on opposite diametrical sides of the mandrel and slidable in opposite directions against a tubular workpiece on the mandrel. A smooth (not toothed) mandrel is employed since tooth elements are to be formed on the outside of the tubular workpiece.

The Killop U.S. Pat. No. 3,982,415 issued Sept. 28, 1978 describes an apparatus for splining a cup-shaped power transmission member wherein a pair of slidable tooth forming racks are employed in conjunction with a hollow, toothed mandrel supported rotatably at opposite open ends by first and second arbors with the annular end wall of the cup-shaped member engaged against the end of the mandrel. The Killop U.S. Pat. No. 4,028,922 issued June 14, 1977 discloses a somewhat similar apparatus adapted for splining a cup-shaped power transmission member wherein the hollow mandrel is affixed to the machine headstock spindle and the open sleeve of a cup-shaped workpart is slid onto the free mandrel end. The sleeve of the workpart is splined along its length to the open end where axial depressions may be formed by the racks. The rack teeth forming the depressions are said to support the open end during splining to reduce out of roundness thereof.

The Jungesjo U.S. Pat. No. 4,155,237 issued May 22, 1979 also discloses a splining machine including a pair of slidable tooth forming racks and a hollow, toothed mandrel. The machine further includes a workpiece unloading member extending from the headstock spindle side of the machine through the hollow mandrel to engage a splined workpart, a slidable loading member on the tailstock side of the machine including a workpart clamp to hold the workpart on the end of the mandrel during splining and rotatable with the mandrel for this purpose, a rotatable indexer mechanism with U-shaped workpart retainers to feed individual parts between the loader and mandrel, and a guide tube between the loader and mandrel for guiding workpiece movement toward and away from the mandrel.

A splining machine is also described in the Hooker U.S. Pat. No. 1,510,889 issued Oct. 7, 1924. In this patent, a cup-shaped sheet metal blank is mounted on a rotatable toothed mandrel with the mandrel received in the open sleeve of the blank and the end wall of the blank engaged against the end of the mandrel by a threaded nut. A hob or rack with gear teeth thereon is mounted such that it can be reciprocated and rotated relative to the mandrel synchronously therewith to intermesh the teeth of the mandrel and hob with the sleeve of the blank therebetween.

And, the Lindell U.S. Pat. No. 3,473,211 issued Oct. 21, 1969 illustrates a machine for rolling internal teeth in the sleeve of a cup-shaped sheet metal power transmission member while the sleeve is supported and clamped on a stationary toothed mandrel. A set of revolving rollers engages the exterior surface of the sleeve to roll the sleeve into the mandrel teeth to form gear type teeth. Also see the McCardell U.S. Pat. No. 3,062,077 issued Nov. 6, 1967 for the pressure forming of internal teeth on a workpart.

The corrugation of tubular or cup-shaped blanks to simultaneously form internal and external tooth-like profiles by a rolling process employing a rotatably mounted toothed mandrel and a pair of rotating dies is known as shown, for example, in the Mason U.S. Pat. No. 76,220 issued Mar. 31, 1868, and Greis et al. U.S. Pat. No. 3,407,638 issued Oct. 29, 1968, the Kiplinger U.S. Pat. No. 3,630,058 issued Dec. 28, 1971 and the Anderson U.S. Pat. No. 4,045,988 issued Sept. 6, 1977.

Clutch hubs of the type of interest are described in the aforementioned Killop U.S. Pat. No. 3,982,415.

SUMMARY OF THE INVENTION

The present invention provides a method and apparatus for improving the roundness of the splined sleeve and sealing surface of a cup-shaped power transmission member by intermeshing the sleeve between a toothed mandrel and pair of special tooth-forming racks. The special tooth-forming racks include a first working section adjacent the leading end with toothed sections interrupted and spaced apart by toothless sections arranged in an alternating sequence so that the sleeve is initially partially deformed at multiple diametrically opposed and spaced apart areas on its circumference and also include a second working section following the first section and having a toothed section, preferably a plurality of uninterrupted tooth sections, to form the spline shape around the sleeve circumference.

The present invention also provides such a method and apparatus which preferably include a pair of special sliding support racks which include a first working section adjacent the leading end and having raised support sections interrupted and spaced apart by non-supporting sections in a selected alternating sequence and configuration to contact the sealing surface when the interrupted toothed sections of each tooth-forming rack deform the sleeve. Each support rack further includes a second working section following the first section and having a raised support section adapted to contact the sealing surface preferably during at least the initial contact of the uninterrupted toothed sections of each tooth-forming rack with the sleeve.

The method and apparatus of the invention have provided a transmission clutch hub having sleeve roundness within 0.025 inch and a sealing surface or sleeve (piston bore surface) within 0.006 inch.

BRIEF DESCRIPTION OF THE DRAWINGS

FIG. 3 is a side elevational view of one of the special tooth-forming racks with the second working section 124 condensed in length relative to the first working section 114 for convenience.

FIG. 4 is a top view of the rack.

FIG. 7 is a side elevational view of one of the special support racks with the second working section 215 condensed in length relative to the first working section 212 for convenience.

FIG. 8 is a top view of the support rack.

DESCRIPTION OF PREFERRED EMBODIMENTS

Figure 1:
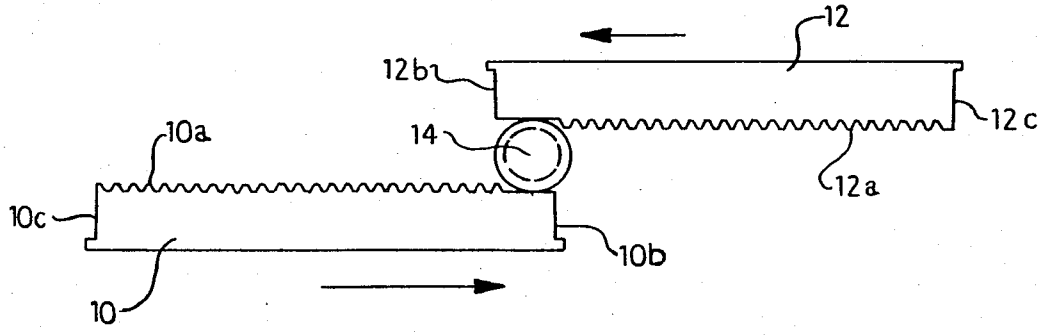
FIG. 1 is a side elevational view in schematic form showing a pair of slidable tooth-forming racks with a mandrel located therebetween.
Figure 2:
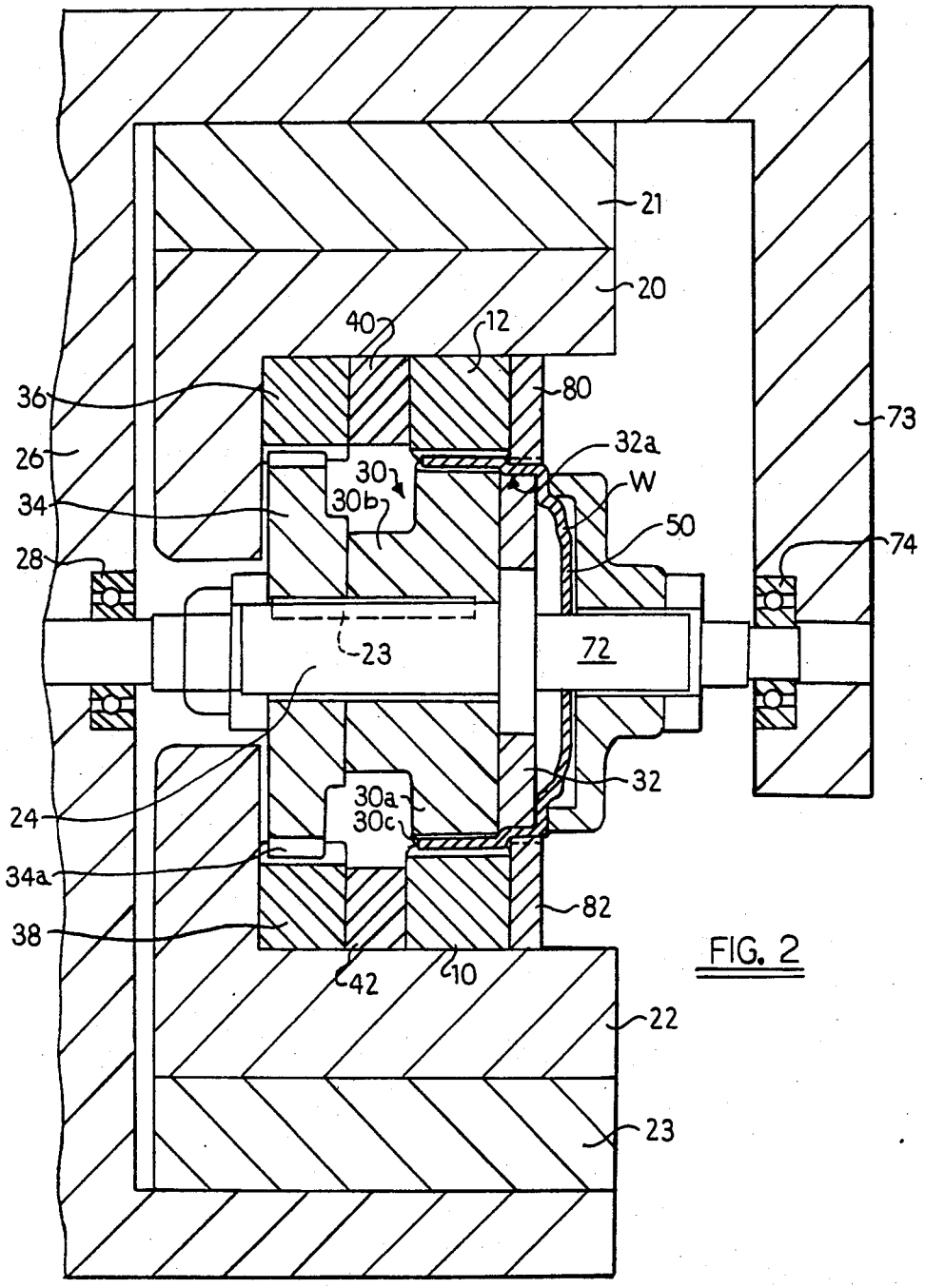
FIG. 2 is a partial sectional view showing a clutch hub blank mounted on the mandrel between a pair of special tooth-forming racks and a pair of special support racks.

FIG. 1 illustrates a machine having a pair of elongate tooth-forming racks 10, 12 and a toothed mandrel 14 supported therebetween. As is well known, the racks 10, 12 are mounted in the machine for sliding motion in opposite directions past opposite sides of the mandrel 14. The racks include transversely-extending tooth 10*a*, 12*a* usually shaped in a pre-selected pattern proceeding from the leading end 10*b*, 12*b* to the trailing end 10*c*, 12*c* of each rack. Each rack has a special tooth pattern therealong which will be described in more detail hereinbelow. FIG. 2 shows the racks 10, 12 mounted on upper and lower L-shaped tool holder plates 20, 22 which, in turn, are carried on upper and lower slide members 21, 23 as is well known in the art. The tooth-forming racks 10, 12 are driven in sliding motion by a suitable drive mechanism, e.g., a hydraulic piston and cylinder system as is also known in the art, e.g., as shown in the McCardell U.S. Pat. Nos. 3,015,243 and 3,214,951 of common assignee herewith and the teachings of which are incorporated herein by reference. The piston and cylinder assemblies are substantially identical in size and are interconnected to a common source of fluid pressure (not shown) with a control valve interposed between the hydraulic assemblies and the common fluid pressure source to simultaneously control both assemblies. The hydraulic assemblies bias the racks 10, 12 concurrently at the same velocity in opposite directions due to the interlocking effect of the hydraulic pressure on the assemblies.

The machine also includes a headstock spindle 24 rotatably supported in the rigid machine frame 26 by anti-friction bearings 28 as is well known, only on set of which is shown in FIG. 2. The spindle 24 extends in cantilever fashion past the machine frame 26 to between the vertically opposed racks 10, 12.

Mounted on the cantilevered end of the spindle 24 by key 23 is a mandrel 30 having a large diameter, externally-toothed portion 30*a* and a smaller diameter portion 30*b*. The mandrel portion 30*a* includes external, outwardly-extending teeth 30*c* adapted to mesh with the teeth 10*a*, 12*a* of the racks. The mandrel teeth 30*c* typically are fully conjugate to the tooth form to be formed in the clutch hub blank W while the teeth of the racks of the present invention have a tooth pattern specially designed to improve the geometry of the splined clutch hub as will be described hereinbelow.

Fastened by suitable means, such as screws and the like, to the mandrel is an annular adapter plate 32 for purposes to be described.

Also keyed on the spindle 24 is a timing gear 34 having teeth 34*a* adapted to mesh with timing racks 36, 38 bolted or otherwise attached to the tool holder plates 20, 22, respectively. The function of the timing gear 34 and timing racks 36, 38 is to insure that rotation of mandrel 24 is coordinated and synchronized with the sliding movement of the racks 10, 12 which must mesh therewith. In particular, the timing gear 34 and racks 36, 38 insure proper meshing between the mandrel and rack teeth.

As is apparent in FIG. 2, spacer members 40, 42 are located between the timing racks 36, 38 and the adjacent tooth-forming racks 10, 12 on the tooling holder plates 20, 22. These spacer members 40, 42 are bolted or otherwise held on the plates.

Figure 9:
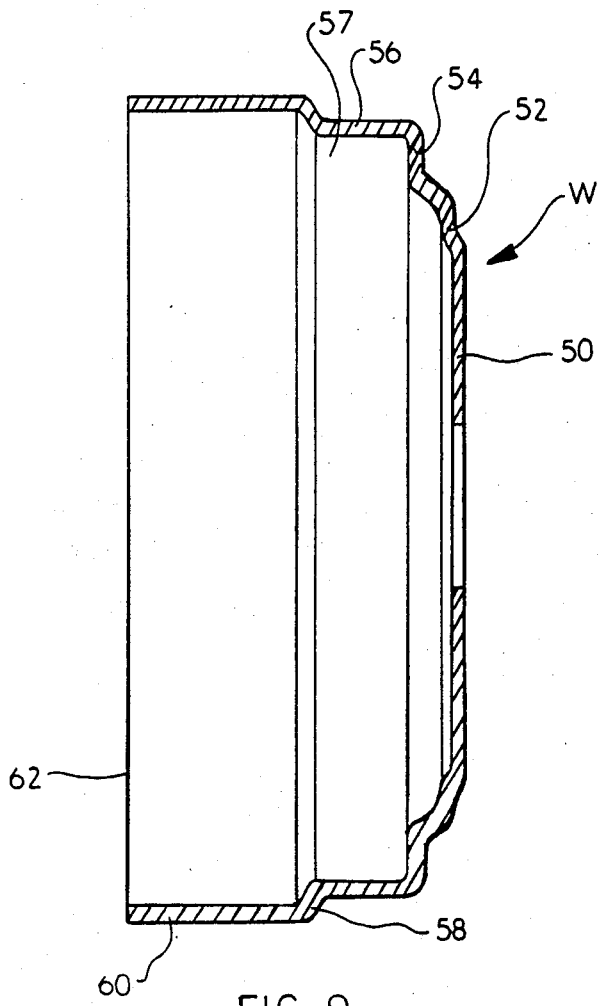
FIG. 9 is a cross-sectional view of a clutch hub blank.

The clutch hub blank W is shown in FIGS. 2 and 8. The clutch hub blank includes an annular end wall 50 connected by annular shoulders 52 and 54 to a cylindrical oil seal surface or sleeve 56 (defining a piston bore 57). The oil seal surface or sleeve 56 is in turn connected by a transition region 58 of curvilinear profile, particularly generally truncated conical shape, to a cylindrical sleeve 60 having an open end 62. The sleeve 60 of the clutch hub will be pressure formed between the mandrel teeth 30*c* and rack teeth 10*a*, 12*a* to form axially-extending splines or teeth 70, FIG. 9.

The clutch hub blank W is mounted on the mandrel 24 with the outwardly projecting mandrel teeth 30*c* engaged with the interior of the sleeve 60 and with the interior of the sealing wall 56 engaged against the annular adapter plate 32 by a member 70 mounted on a freely rotating tailstock spindle 72. The spindle 72 is rotatably supported in the machine frame extension 73 by anti-friction bearings 74 as is well known and illustrated in the aforementioned McCardell U.S. patents. It is apparent that the interior of the sealing wall 56 is supported against the cylindrical outer surface 32*a* of the adapter plate.

To form the sleeve 60 and sealing sleeve 56, a pair of special tooth-forming racks 10, 12 and a pair of special support racks 80, 82 are used in conjunction with the mandrel 30 and adapter plate 32 described above. The tooth-forming racks 10, 12 are mounted on the L-shaped tool holder plates 20, 22 in spaced apart, vertically opposed or facing relation with the large diameter mandrel section 30*a* and sleeve 60 therebetween as shown while the support racks 80, 82 are mounted adjacent the tooth-forming racks 10, 12 on the tool holder plates 20, 22 in spaced apart, vertically opposed relation with the adapter plate 32 and sealing wall 56 therebetween.

The tooth-forming racks 10, 12 are identical and one of the racks is illustrated in FIGS. 3 and 4. Each rack 10, 12 includes an elongated, rectilinearly-shaped body 102 having a leading end 104 with a mounting flange 106 and a trailing end 108 with a mounting flange 110. The flanges 106, 110 are clamped onto the L-shaped tool holder plates 20, 22. Each rack 10, 12 includes a working surface 112 which is placed in spaced apart, facing relation to the other with the sleeve 60 therebetween when the racks are mounted on the tool holder plates 20, 22 as shown in FIGS. 1 and 2.

Extending from the leading end 104 toward the trailing end 108 (e.g. to line 109) each rack includes a first working section 114 on the working surface and comprised of toothed sections 116 interrupted and spaced apart by toothless sections 118 in an alternating sequence. The length and spacing of the toothed sections 116 and toothless sections 118 is selected to provide initial deformation of the sleeve at spaced, circumferential locations around the sleeve. Typically, the first working section 114 of each rack is designed with a length $L_1$ to contact the sleeve 60 for one-half sleeve revolution when the racks are mounted on the machine; i.e., $L_1$ is equal to one-half the circumference of sleeve 60. As shown in FIG. 2, the contact of the toothed sections 116 with sleeve 60 is synchronized by means described above so that contact of the racks is in diametrically opposed areas on the circumference of the sleeve 60.

Figure 5:
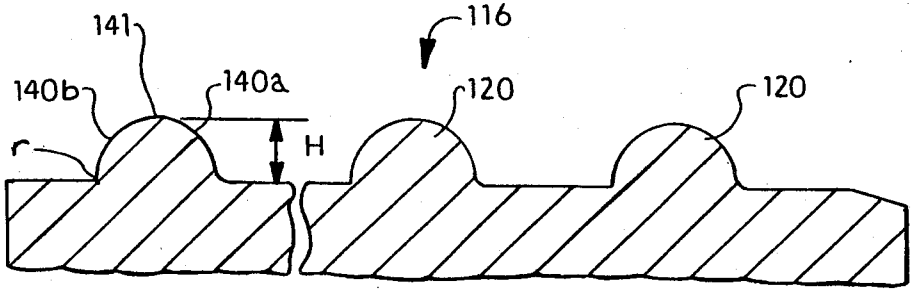
FIG. 5 is a partial elevation of the tooth shape on the first working section of each tooth-forming rack.

The teeth 120 of the toothed sections 116 are preferably of similar shape from one section to the next and the tooth shape or profile is illustrated in FIG. 5, taking the form of a gothic or equilateral pointed arch shape provided in part by leading and trailing tooth edges 140*a* and 140*b*. The half pointed arch form between the top 141 and root r of both the leading and trailing edges 140*a*, 140*b* is shown at a height H which is approximately 90%, typically between 80% and 90%, of the full conjugate tooth height which is to be developed in the sleeve 60. The radius R shown in FIG. 5 is approximately 0.150 inch on both the leading and trailing edges. The height H of the teeth remains constant from one toothed section 116 to the next, although the number of teeth in each section may vary, e.g., the number of teeth per toothed section typically increase as one proceeds from the leading rack end 104 toward the line 109. For example, the first two toothed sections 116 are shown including three teeth of the type described whereas the third toothed section adjacent line 109 includes four teeth of this type.

Beginning at line 109 and extending to the trailing end 108 of each rack is a second working section 124 having transversely-extending teeth arranged in an uninterrupted pattern described in pending U.S. patent application Ser. No. 347,747 filed Feb. 10, 1982 in the names of Paul Fitzpatrick and Robert R. Ridley and of common assignee herewith, the teachings of which are incorporated herein by reference.

Figures 6A, 6B, 6C:
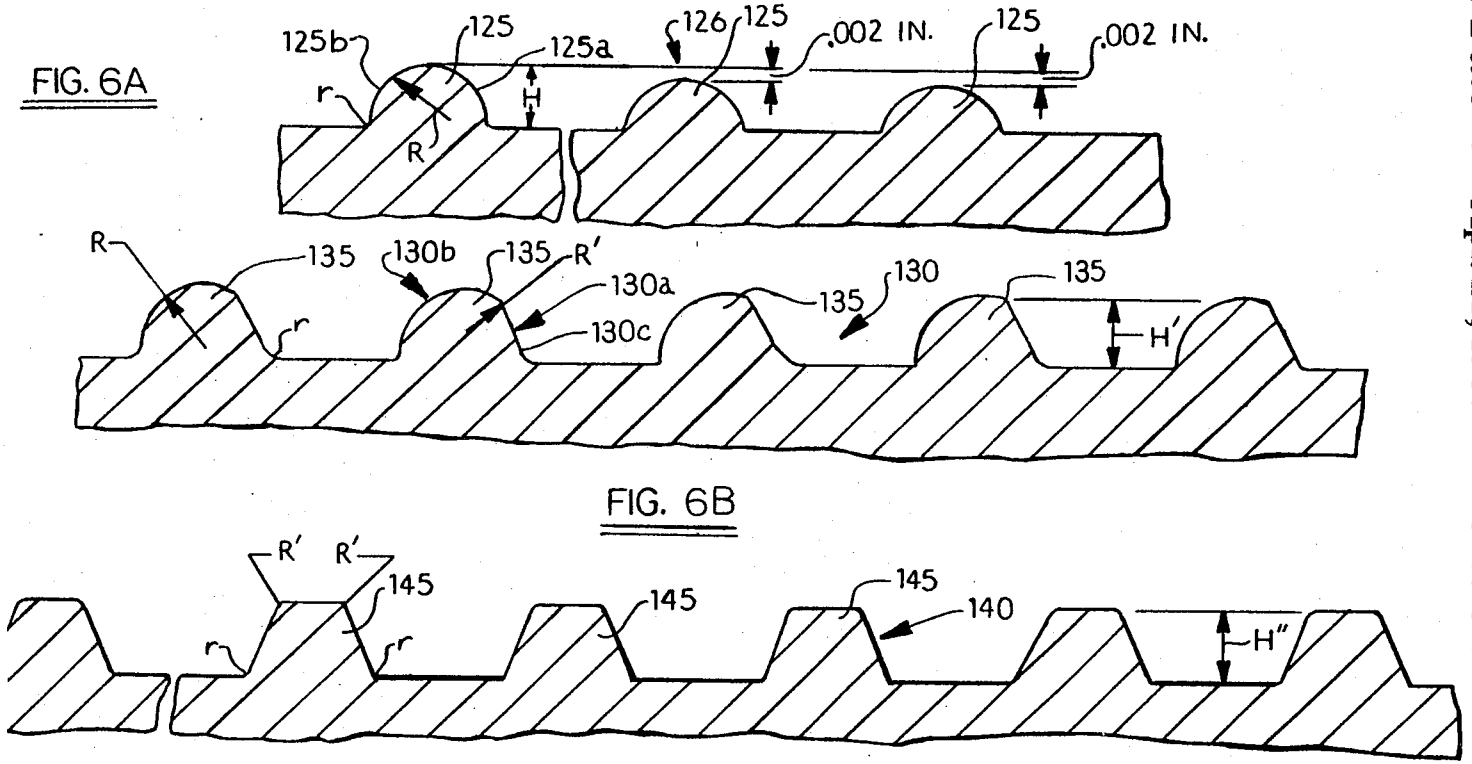
FIGS. 6A, 6B and 6C are side elevational views of the different tooth profiles along the second working section of each tooth-forming rack.

Briefly, the second working section 124 is shown greatly condensed in length for convenience and comprises a first toothed section 126 extending from line 109 to line 128 and having teeth 25 of the gothic or equilateral pointed arch shape shown in FIG. 6A defined by leading and trailing edges 125*a*, 125*b*. Typically, the tooth height H in the first section 126 gradually increases from line 109 toward line 128 for the first six teeth. For example, the teeth may increase in height by 0.002 inch from one tooth to the next to the sixth tooth. Typically, the first tooth of this section 126 will have a tooth height about equal to that of the teeth in the first working section 114. After the sixth tooth, the height H of the remaining teeth, usually 18 in number, remains constant and corresponds to the height of the sixth tooth. First toothed section 126 has length corresponding to one-half of the circumference of sealing wall 56.

The second section 130 has teeth 135 extending from line 128 to line 131. The eighteen teeth in this section of the tool have the asymmetrical configuration shown in FIG. 6B. Here, the height of the tooth form H′ will be approximately 96% of the full conjugate tooth height. The teeth can be seen to have a large radius R on the trailing edge 130*b* of the tooth form which is substantially the same radius as that in the previous section, that is, a 0.130 inch radius like teeth 125 shown in FIG. 6A. The leading edge 130*a* of the tooth, however, will have a small radius portion R′ which will be only approximately 55 thousandths and conjugate to the leading edge of the tooth to be formed in the workpiece and will be discussed in more detail later. Preferably, the leading flank portion 130*c* of the teeth in the second section will also be conjugate to the leading flank of the tooth to be formed. The radius r at the root of the tooth will be consistent throughout the tool. Also shown here are additional teeth having an identical configuration as that of the tooth just described. The teeth of section 130, as noted earlier, total approximately eighteen in number and extend from line 128 to line 131.

The third section 140 contains teeth 145 shown in FIG. 6C. The teeth of section 140 will all have the symmetrical shape of the teeth shown which is the full conjugate tooth form of the tooth form to be formed in the sleeve having radii R′ of about 55 thousandths at both the leading and the trailing edge of the tooth form and having a radius of r at the root of the tooth form. The height of the tooth form H″ here will be considered 100% in viewing the relationship of these teeth to the other teeth on the too. The teeth 145 will extend between line 131 and line 141 with approximately 24 teeth having this full configuration.

A fourth toothed section 150 is preferably provided from line 141 to line 151 and includes about twenty-four teeth having the symmetrical conjugate tooth form of teeth 145 (FIG. 6C), except that the tooth flanks and root in section 150 are relieved compared to those of teeth 145 by for example 0.003 inch. That is, the tooth height in section 150 is 3 thousandths greater than tooth height H″ in section 140 and the tooth addendum is likewise greater by 3 thousandths. The tooth height in section 150 would be considered 102%. The leading and trailing edge radii of the teeth in section 150 are the same as those of teeth 145, namely about 55 thousandths. The purpose of the teeth in section 150 is to iron or set the metal shell at the minor (inner diameter) after splining by the previous tooth sections.

A final section 160 which will extend from line 151 to the trailing end 108 will have approximately six teeth in number. These teeth will have the same configuration as shown in FIG. 6C except beginning at the sixth tooth from the trailing end, a top taper (0.002 inch relief) will occur so that the last tooth in section 160 will be 10 thousandths lower than height H″. In other words, the last tooth will have a height approximately 93% of the full height of the teeth 155.

It is apparent that, except for sections 126 and 160, the root line within each section of teeth is preferably constant although the root line from one section of teeth to another may vary. The linear pitch for all of the teeth of the tools 10 and 12 will be the same and will be selected to produce the desired tooth form on the sleeve of the power transmission blank W. The tooth form and circular pitch provided on the mandrel 30*c* depends on the inner section or inner tooth form desired and is correlated with the tooth form provided on the tools 10 and 12 as is well known in the art.

As mentioned hereinabove, the tooth pattern on the second working section 124 of each rack 10, 12 is described in pending U.S. application Ser. No. 347,747 previously incorporated herein by reference.

The support racks 80, 82 are identical, the features thereof being shown in FIGS. 6 and 7 for one of the support racks. Each support rack 80, 82 includes an elongated, rectilinearly-shaped body 200 having a leading end 202 with a mounting flange 204 and a trailing end 206 with a mounting flange 208. Each rack includes a working surface 210 which is placed in spaced apart, facing relation to the other working surface with the sealing wall 56 therebetween when the racks 80, 82 are mounted on the tool holder plates 20, 22 as shown in FIG. 2.

The working surface 210 of each support rack 80, 82 includes a first working section 212 extending from the leading end 202 to line 214 and second working section 215 extending from line 214 to the trailing end 206. The first working section 212 is comprised of a plurality of raised flat support sections 216 interrupted and spaced apart by lower non-supporting sections 218 in an alternating sequence. The length and alternating sequence of the raised sections 216 and lower sections 218 are correlated to those of the toothed sections 116 and toothless sections 118 so that the raised support sections contact the sealing surface or sleeve 56 when the toothed sections 116 contact the sleeve 60 during the first full revolution thereof. The height of the raised sections 116 is 0.020 to 0.030 inch above non-supporting sections 218 whereas the overall length $L_2$ of the first working section 212 corresponds to one-half revolution or one-half of the circumference of sealing wall 56.

The second working section 215 is shown condensed in length to the same extent as first working section 124 of the tooth-forming racks and includes a raised flat support section 222 having a length corresponding to one-half the circumference of the sealing wall 56 and a height equal to that of the raised sections 216 so that the raised section 222 contacts the sealing sleeve 56 during the time that toothed section 126 contacts the sleeve 60.

After the raised flat section 222 is a lower non-supporting section 225 which does not contact the sealing sleeve 56.

During the actual pressure rolling operation, the tooth-forming racks 10, 12 and support racks 80, 82 are driven to slide in opposite directions past the mandrel large diameter portion 30*c* and adapter plate 32 with the rack teeth intermeshing with the mandrel teeth 30*c* with the sleeve 60 therebetween and with the raised sections contacting the sealing wall 56 supported on the adapter surface 32*a* when the rack teeth engage the sleeve. During initial deformation, the interrupted toothed sections 116 deform the sleeve 60 in areas spaced circumferentially, e.g., 60° apart, to initially even out deformation and avoid the wave effect in the sleeve 60 ahead of the tooth-forming racks, which effect has been observed in past practice of forming splines with a toothed mandrel and a pair of sliding toothed racks and to result in out-of-roundness of the splined sleeve. Minimization of the wave effect results in reduced out-of-roundness not only in the sleeve 60 but also in the sealing sleeve 56 connected thereto. Support of the sealing device 56 by the raised sections 216 when toothed sections 116 initially deform the sleeve further minimizes out-of-roundness thereof. Similarly, support of the sealing wall 56 by the raised section 222 when toothed section 126 deforms the sleeve 60 also minimizes out-of-roundness thereof. The wave effect is discussed in pending U.S. application Ser. No. 347,748 filed Feb. 10, 1982 in the name of Nicholas J. Carene of common assignee herewith, the teachings of which are incorporated herein by reference.

Figure 10:
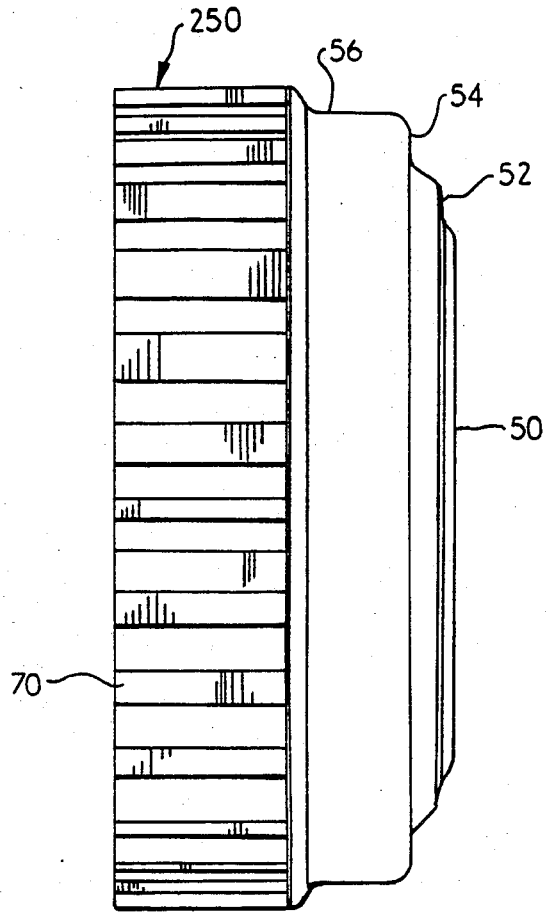
FIG. 10 is a similar view of the splined clutch hub.

The clutch hub P thus obtained , FIG. 10, is characterized as having a roundness of the splined sleeve 250 within 0.025 inch, usually 0.020 inch, and a roundness of the sealing sleeve 56 within 0.005 inch.

While certain preferred embodiments of the method and apparatus of the invention have been disclosed in detail herein, those familiar with this art will recognize that various modifications and changes can be made therein for practicing the invention as defined by the following claims.

I claim:

1. The combination of a mandrel disposed in a cylindrical sleeve of a power transmission member and rack tool means for supporting the cylindrical sleeve on a power transmission member as the sleeve rotates about its longitudinal axis with the mandrel therein during splining of another sleeve thereof by a toothed rack tool means, said rack tool means comprising a pair of sliding spaced apart facing support racks each having a body with a leading and trailing end and with a working surface therebetween, each said working surface including a first working section extending from the leading end toward the trailing end and having a plurality of substantially coplanar support sections for supportingly contacting the rotating sleeve with the support section interrupted and spaced apart in a direction from the leading end toward the trailing end by non-supporting sections in an alternating sequence from the leading end toward the trailing end and including a second working section extending from the first working section toward the trailing end and having another support section substantially coplanar with said plurality of support sections, the working surfaces of the support racks being disposed relative to one another and to the mandrel such that the support sections tangentially supportingly contact the cylindrical sleeve on diametrically opposite sides thereof without substantially radially deforming the sleeve as the support racks slide therepast.

2. The combination of claim 1 wherein the length of the support sections of the first working section increases toward the trailing end.

3. The combination of claim 1 wherein said another support section of the second working section is followed by a non-supporting section.

* * * * *

UNITED STATES PATENT AND TRADEMARK OFFICE

CERTIFICATE OF CORRECTION

PATENT NO. : 4,658,619

DATED : April 21, 1987

INVENTOR(S) : Gary R. Hill

It is certified that error appears in the above-identified patent and that said Letters Patent is hereby corrected as shown below:

Column 8, line 26, "on a" should read -- on the --

Column 8, line 37, "section" should read -- sections --.

Signed and Sealed this

First Day of September, 1987

*Attest:*

*Attesting Officer*

DONALD J. QUIGG

*Commissioner of Patents and Trademarks*